US011933135B2

(12) United States Patent
Liu et al.

(10) Patent No.: US 11,933,135 B2
(45) Date of Patent: Mar. 19, 2024

(54) METHOD FOR PREDICTING ANNULAR FLUID EXPANSION IN A BOREHOLE

(71) Applicant: Landmark Graphics Corporation, Houston, TX (US)

(72) Inventors: Zhengchun Liu, Sugar Land, TX (US); Robello Samuel, Cypress, TX (US); Adolfo Gonzales, Houston, TX (US); Jun Jiang, Austin, TX (US); Yongfeng Kang, Katy, TX (US)

(73) Assignee: Landmark Graphics Corporation

( * ) Notice: Subject to any disclaimer, the term of this patent is extended or adjusted under 35 U.S.C. 154(b) by 99 days.

(21) Appl. No.: 17/620,334

(22) PCT Filed: Jan. 14, 2020

(86) PCT No.: PCT/US2020/013485

§ 371 (c)(1),
(2) Date: Dec. 17, 2021

(87) PCT Pub. No.: WO2021/040778

PCT Pub. Date: Mar. 4, 2021

(65) Prior Publication Data

US 2022/0290528 A1 Sep. 15, 2022

Related U.S. Application Data

(60) Provisional application No. 62/890,939, filed on Aug. 23, 2019.

(51) Int. Cl.

| | |
|---|---|
| ***E21B 43/16*** | (2006.01) |
| ***E21B 33/14*** | (2006.01) |
| ***E21B 41/00*** | (2006.01) |

(52) U.S. Cl.
CPC ..... *E21B 33/14* (2013.01); *E21B 41/00* (2013.01)

(58) Field of Classification Search
CPC ..... E21B 33/14; E21B 41/00; E21B 43/16; E21B 47/007; E21B 33/12; E21B 33/04;
(Continued)

(56) References Cited

U.S. PATENT DOCUMENTS 5,919,720 A * 7/1999 Sleight ..... C04B 35/495 501/153
8,983,819 B2 3/2015 Jiang
(Continued)

OTHER PUBLICATIONS

A.S. Halal et al., Casing Design for Trapped Annular Pressure Buildup, Jun. 1994, pp. 107-114, SPE Drilling & Completion, US.
(Continued)

*Primary Examiner* — Edwin J Toledo-Duran
(74) *Attorney, Agent, or Firm* — K&L Gates LLP

(57) ABSTRACT

A method for determining annular fluid expansion ("AFE") within a borehole with a sealed casing string annulus. The method may include defining a configuration of the borehole. The method may further include defining a production operation and a borehole operation. The method may also include determining AFE within the borehole when performing the production operation. The method may further include determining AFE within the borehole when performing the borehole operation based on the AFE within the borehole when performing the production operation.

12 Claims, 4 Drawing Sheets

(58) Field of Classification Search
CPC . E21B 43/12; E21B 43/26; E21B 7/00; G06F 30/20; G06F 17/50; C09K 8/03; G01V 99/00; G06G 7/48; G06G 7/50; G06G 7/64
See application file for complete search history.

(56) References Cited

U.S. PATENT DOCUMENTS 9,009,014 B2 * 4/2015 Mitchell ..... G06F 30/20 703/10
9,850,737 B2 12/2017 Liu
10,041,344 B2 8/2018 Mitchell
2004/0168830 A1 * 9/2004 Reddy ..... C09K 8/38 175/71
2005/0194144 A1 * 9/2005 Vargo, Jr. ..... E21B 33/13 166/292
2006/0213663 A1 * 9/2006 Vargo, Jr. ..... C09K 8/032 166/292
2007/0005316 A1 * 1/2007 Paez ..... E21B 10/46 703/10
2008/0173454 A1 * 7/2008 Smithson ..... E21B 23/04 166/324
2008/0210440 A1 * 9/2008 Stuart ..... E21B 23/01 166/207
2008/0236843 A1 * 10/2008 Scott ..... E21B 43/12 166/386
2008/0262802 A1 10/2008 Halabe
2010/0236780 A1 * 9/2010 Hermes ..... C09K 8/42 166/288
2013/0017980 A1 * 1/2013 Williams ..... E21B 33/13 507/202
2013/0180715 A1 * 7/2013 Harris ..... E21B 33/04 166/208
2014/0019102 A1 * 1/2014 Mitchell ..... G06F 30/20 703/6
2014/0019107 A1 * 1/2014 Jiang ..... E21B 43/12 703/10
2014/0034390 A1 2/2014 Mitchell
2014/0054038 A1 * 2/2014 James ..... C04B 28/02 106/796
2014/0110101 A1 * 4/2014 Craster ..... E21B 17/00 166/242.4
2014/0196953 A1 * 7/2014 Chitwood ..... E21B 7/068 175/57
2015/0184495 A1 * 7/2015 Zhou ..... C04B 38/009 166/310
2016/0146962 A1 * 5/2016 Hayward ..... E21B 47/107 166/250.1
2016/0245027 A1 * 8/2016 Gumus ..... E21B 44/00
2016/0370498 A1 * 12/2016 Liu ..... E21B 34/06
2017/0247983 A1 * 8/2017 Funkhouser ..... C09K 8/032
2017/0316121 A1 * 11/2017 Liu ..... G06F 30/20
2018/0096083 A1 * 4/2018 Kang ..... E21B 41/00
2020/0148945 A1 * 5/2020 Narhi ..... E21B 43/08
2021/0309906 A1 * 10/2021 Gordon ..... E21B 43/00
2022/0259948 A1 * 8/2022 Liu ..... E21B 41/00
2022/0290528 A1 * 9/2022 Liu ..... E21B 33/14

OTHER PUBLICATIONS

International Search Report and Written Opinion dated May 21, 2020 for PCT Application No. PCT/US2020/013485 filed Jan. 14, 2020.

* cited by examiner

METHOD FOR PREDICTING ANNULAR FLUID EXPANSION IN A BOREHOLE

BACKGROUND

This section is intended to provide relevant background information to facilitate a better understanding of the various aspects of the described embodiments. Accordingly, these statements are to be read in this light and not as admissions of prior art.

A natural resource such as oil or gas residing in a subterranean formation can be recovered by drilling a well into the formation. The subterranean formation is usually isolated from other formations using a technique known as cementing. In particular, a borehole is drilled into to the subterranean formation while circulating a drilling fluid through the borehole. After the drilling is terminated, a string of pipe (e.g. casing string) may be run in the borehole.

Primary cementing is then usually performed by pumping a cement slurry down through the casing string and into the annulus between the casing string and the wall of the borehole or another casing string to allow the cement slurry to set into an impermeable cement column and thereby fill a portion of the annulus. Sealing the annulus typically occurs near the end of cementing operations after well completion fluids, such as spacer fluids and cements, are trapped in place to isolate these fluids within the annulus from areas outside the annulus. The annulus may be sealed by closing a valve, energizing a seal, and the like.

After completion of the cementing operations, production of the oil or gas may commence. The oil and gas are produced at the surface after flowing through the tubing or casing string. As the oil and gas pass through the tubing or casing string, heat may transfer from such fluids through the tubing or casing string and into the annulus. As a result, thermal expansion of the fluids in the sealed annulus above the cement column causes an increase in pressure within the sealed annulus also known as annulus pressure buildup ("APB"). In order to maintain a safe and acceptable pressure within the sealed annulus, the pressure within the sealed annulus must be predicted within some level of certainty.

BRIEF DESCRIPTION OF THE DRAWINGS

Embodiments of the method for predicting annular fluid expansion in a borehole are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes a method for predicting annular fluid expansion ("AFE") within a borehole. The annular pressure buildup ("APB") can then be calculated based on the predicted AFE and the well design can be modified as necessary to address the calculated APB.

Figure 1:
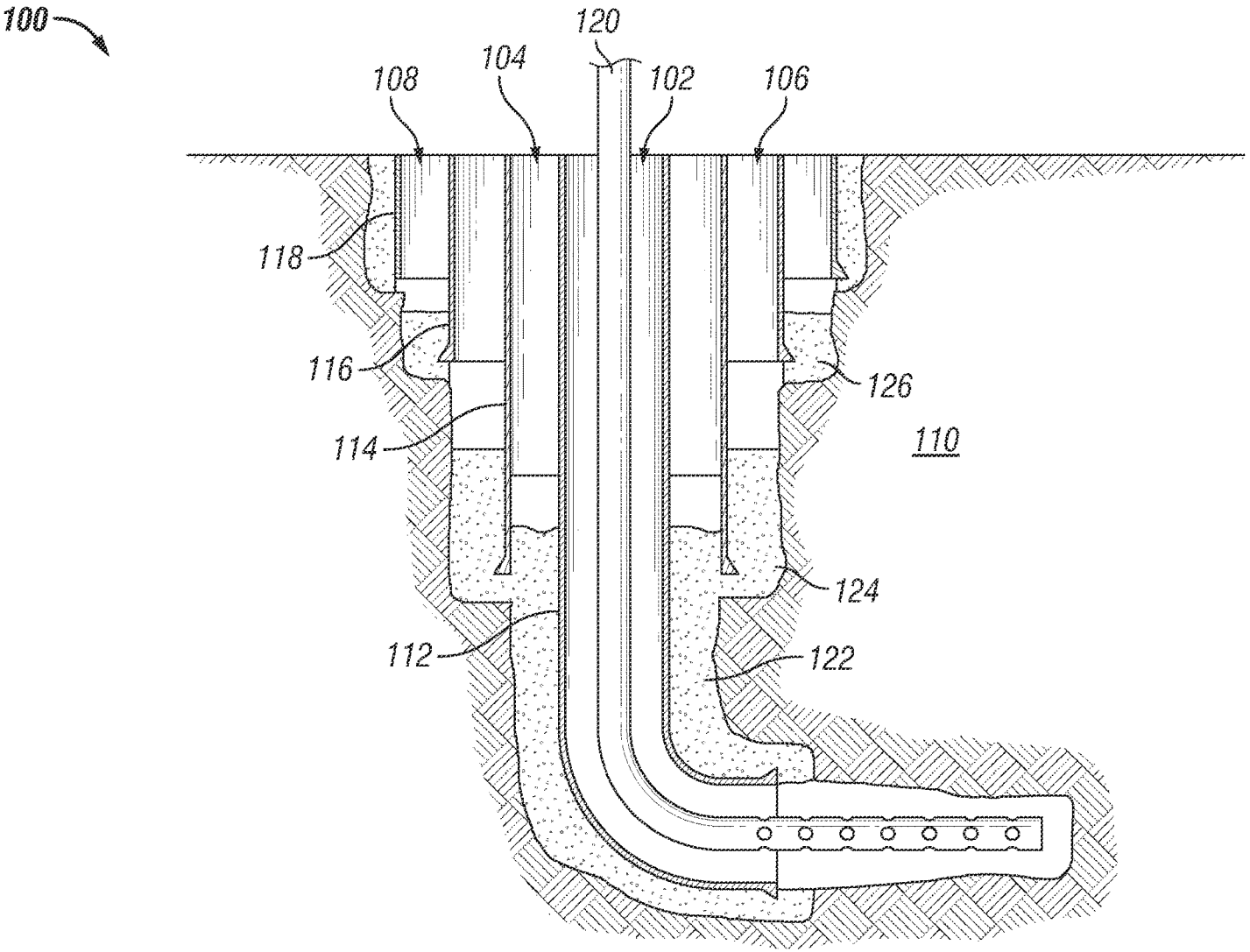
FIG. 1 is a cross-sectional diagram a borehole having multiple annuli, according to one or more embodiments.

FIG. 1 is a cross-sectional diagram a borehole 100 having multiple annuli 102, 104, 106, 108, according to one or more embodiments. As shown in FIG. 1, a borehole 100 extends through a subterranean formation 110. Within the borehole 100, concentrically placed casing strings 112, 114, 116, 118 define multiple annuli 102, 104, 106, 108. While shown with four concentric annuli 102, 104, 106, 108, depending on the length of the borehole 100, any number concentric annuli may be present. In at least one embodiment, the innermost annulus 102, which is formed between the innermost casing string 112 and production tubing 120 extends through a portion of the borehole 100, as shown in FIG. 1. In other embodiments, the innermost casing string 112 and, therefore, the annulus 102, may extend through the entire borehole 100. Although FIG. 1 has depicted the borehole 100 as having a substantially horizontal section and a substantially vertical section, one skilled in the art will appreciate that any borehole orientation may be present.

In traditional cementing with concentric casing strings 112, 114, 116, 118, cement is introduced through the innermost (at the time) casing string and upwardly displaces into the annulus defined between the newly placed casing string and the previously placed one. In reverse circulation cementing operations, cementing fluids are placed down through the annulus and into the bottom of the casing. In either case, the goal is for the cement to completely fill the annular space at the bottom of the annulus 102, 104, 106, 108. The selected cementing process continues as additional casing strings 112, 114, 116 are placed within the borehole 100. The introduction of cement into the annuli 104, 106, 108 results in the formation of sealing cement plugs 122, 124, 126 within the lower portions of the annuli 104, 106, 108, thereby preventing the annular fluid from moving through the lower termini.

The upper portions of the annuli 104, 106, 108 are also sealed, thereby trapping the annular fluid within a confined space. When both the upper portions and lower portions of the annuli 102, 104, 106, 108 are sealed, a pressure increase, also known as APB, can occur as the trapped annular fluid undergoes thermal expansion due to exposure to high-temperature produced fluids.

Figure 2:
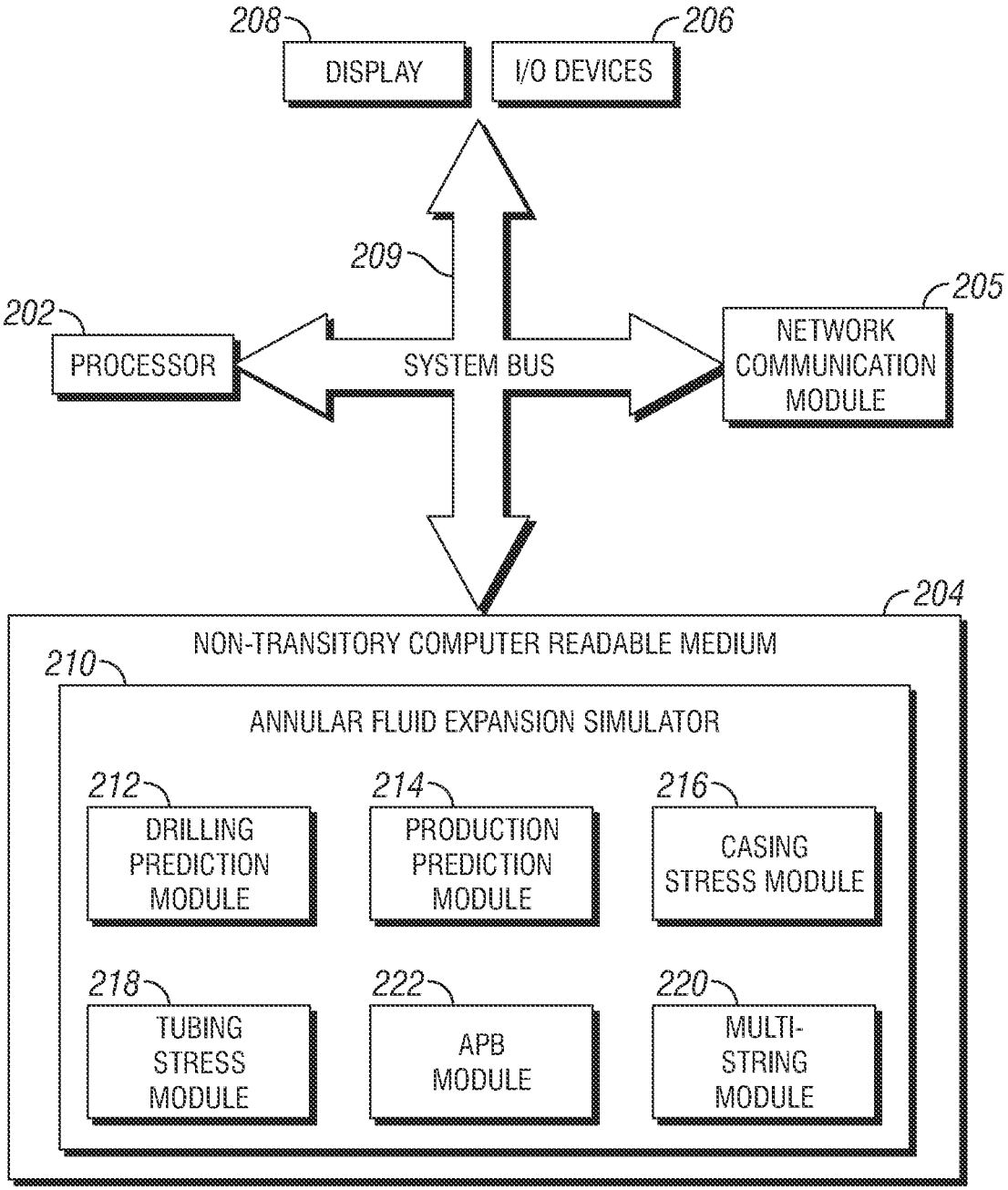
FIG. 2 is a block diagram of an annular fluid expansion ("AFE") simulation system, according to one or more embodiments.

FIG. 2 is a block diagram of an AFE simulation system 200 according to one or more embodiments. In at least one embodiment, the AFE simulation system 200 includes at least one processor 202, a non-transitory computer readable medium 204, a network communication module 205, optionally an input/output devices 206, and optionally a display 208, all interconnected via a system bus 209. Software instructions executable by the processor 202 for implementing software instructions stored within the AFE simulation system 200 in accordance with the illustrative embodiments described herein, may be stored in the non-transitory computer readable medium 204 or some other non-transitory computer-readable medium.

Although not explicitly shown in FIG. 2, it will be recognized that the AFE simulation system 200 may be connected to one or more public and/or private networks via appropriate network connections. It will also be recognized that the software instructions comprising the AFE simulator 210 may also be loaded into the non-transitory computer readable medium 204 from a CD-ROM or other appropriate non-transitory computer readable medium via wired or wireless means.

FIG. 2 further illustrates a block diagram of an annular fluid expansion ("AFE") simulator 210 according to an illustrative embodiment of the present disclosure. The AFE simulator 210 comprises a drilling prediction module 212, a production prediction module 214, a casing stress module 216, a tubing stress module 218, a multi-string module 220, and an APB module 222, as shown in FIG. 2. However, this disclosure is not thereby limited. In some embodiments, the modules 212, 214, 216, 218, 220, and 222 may be combined to form a single module or to form fewer models than shown in FIG. 2. In other embodiments, additional modules may be added to the AFE simulator 210. Based upon the input variables as described below, the algorithms of the various modules combine to provide the AFE analysis of a sealed casing string annulus, such as the sealed casing string annuli 104, 106, 108 formed by the casing strings 112, 114, 116, 118 within the borehole 100 shown in FIG. 1.

The drilling prediction module 212 simulates, or models, drilling events and the associated well characteristics such as the drilling temperature and pressure conditions present downhole during logging, trip pipe, casing, and cementing operations.

The production prediction module 214 models production events and the associated well characteristics such as the production temperature and pressure conditions present downhole during circulation, production, injection, gas lift, and shut in operations above and below the end of the operating string.

The casing stress module 216 models the stresses caused by changes from the initial to final loads on the casing string, as well as the temperature and pressure conditions affecting the casing.

The tubing stress module 218 simulates the stresses caused by changes from the initial to final loads on the tubing, as well as the temperature and pressure conditions affecting the tubing above and below the end of the operating string.

The modeled data received from the foregoing modules is then fed into the APB module 222 which analyzes the APB of the final conditions from the initial conditions. Thereafter, the data modeled in APB module 222 is then fed into the multi-string module 220 for stress and safety factors calculation for each string. One skilled in the art having the benefit of this disclosure realize there are a variety modeling algorithms that could be employed to achieve the results of the foregoing modules.

In view of the foregoing, the AFE simulation system 200 is comprised of two primary components and their associated functions: a Graphical User Interface ("GUI") (e.g., the display 208) and the calculation engines provided by the AFE simulator 210. In certain illustrative embodiments, the GUI provides various functions. First, via the GUI, the formation around the borehole is defined by the user, including the undisturbed temperature profile, the pore pressure, the fracture pressure, the rock information, etc. Second, the borehole is defined by the user, including the casing and tubing definitions, the fluids in the tubing and annulus, cements, the wellpath, packer depth, and packer types. Third, the operation details are defined by the user, including the type of operation (e.g., fracturing, injection, production, or circulation, etc.), fluid types, operation details (e.g., operation depth including operation above the end of string, flowrate, inlet temperatures, duration, etc.), flow path (e.g., through tubing or annulus, if circulation-forward circulation or reverse circulation), simulation conditions (e.g., transient or steady state, operation link), load types, and linking temperature and pressure source for stress calculations, etc.

In at least one embodiment, the AFE simulation system 200 also prepares the input file to the calculation modules of the AFE simulator 210 in a formatted form, such that analysis and calculation is most efficient. The output of the AFE simulation system 200 may take a variety of forms. For example, the output may be in the form of a display or printed report such as plots, spreadsheets, or graphics. The reports may include, for example, data related to temperature and pressure profile results, fluid properties (e.g., density, viscosity, liquid hold up, flow regime, etc.), load, stress, safety factors (e.g., axial, triaxial, collapse, burst), displacement, movement, trapped annular pressure build-up, etc.

The various calculation modules of the AFE simulator 210 perform a variety of functions, such as reading and processing formatted input files prepared by the AFE simulation system 200. Further, the calculations performed by the modules 212, 214, 216, 218, 222, 220 are numerous. For example, thermal responses of the simulated borehole may be calculated, including the heat transfer and fluid flows of the selected operations with the specified formation and borehole configurations. In addition, other heat transfer and fluid flow related data may be calculated, including the simulated conditions (e.g., transient or steady state), fluid types, operation depth (including depth above the end of string), flowrate, inlet temperature, duration, flow direction (e.g., injection, production, forward circulation or reverse circulation), reference pressure and location (at wellhead or at perforation) of heat transfer and/or fluid flows, etc.

Other functions provided by the calculation modules of the AFE simulator 210 include stress analysis. Here, one or more of modules 212, 214, 216, 218, 222, 220 compute, for example, the loads associated with the borehole configuration input via the GUI (e.g., the display 208) by a user, the mechanical properties of the casing and tubing, the internal and external pressure and temperature (based upon the thermal analysis), load type (e.g., over-pull, pressure test, running in hole, tubing evacuation, etc.), the combined loads of internal and external density/pressure and associated temperature (calculated based upon the thermal and flow analysis), etc.

The AFE simulator 210 then runs an AFE analysis on an overall borehole system. Here, based upon the analysis of one or more of the modules 212, 214, 216, 218, 220, 222, simulator 210 calculates the resulting effects on the various annular contents, initial and final conditions (e.g., temperature and pressure change), load history, wellhead installation and load configuration, etc. to thereby provide an output analysis used to plan, conduct, or review a given borehole operation. The above calculations may be performed by one or more of the modules 212, 214, 216, 218, 222, 220.

As described above, the output of AFE simulation system 200 may be displayed to a user via a GUI (e.g., the display 208) in the form of a plot, spreadsheet, graphics, etc. The thermal analysis data may include a borehole temperature profile (e.g., tubing, casing, fluid, and cement profiles), fluid pressure profile, near borehole formation temperature profile, temperature and pressure change as a function of time, fluid velocity, fluid properties (e.g., density, viscosity, liquid hold up, flow regime, etc.), steam quality (if steam is used), etc. The stress analysis data may include initial and final temperature and axial load change conditions, safety factors (e.g., axial, tri-axial, burst, collapse, envelop), design limits, displacement and length change, packer load schematics, minimum safety factors, etc. The borehole system analysis may include APB, the impact of APB on the stress analysis (e.g., safety factors, stress, length change, string displacement, design limits, etc.), and AFE.

The AFE simulation system 200 output is used to determine what types of piping should be used to form the casing strings of a given well. Additionally the AFE simulation system 200 may be used to determine if a casing string can maintain structural integrity during future workover and/or abandonment operations via stress analysis.

Figure 3A:
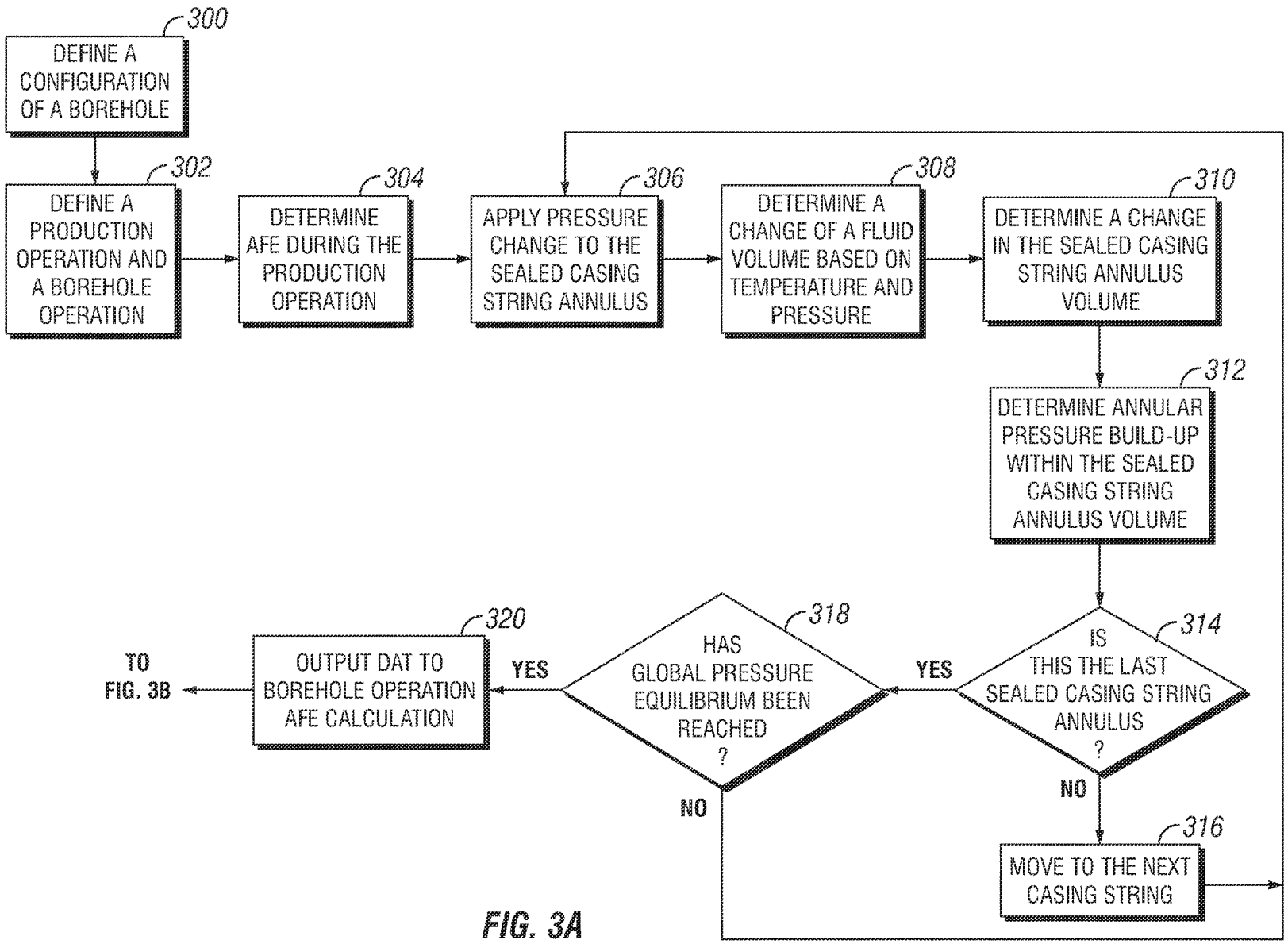
FIG. 3A is a first portion of a flow chart of a method for determining AFE within a borehole, according to one or more embodiments.
Figure 3B:
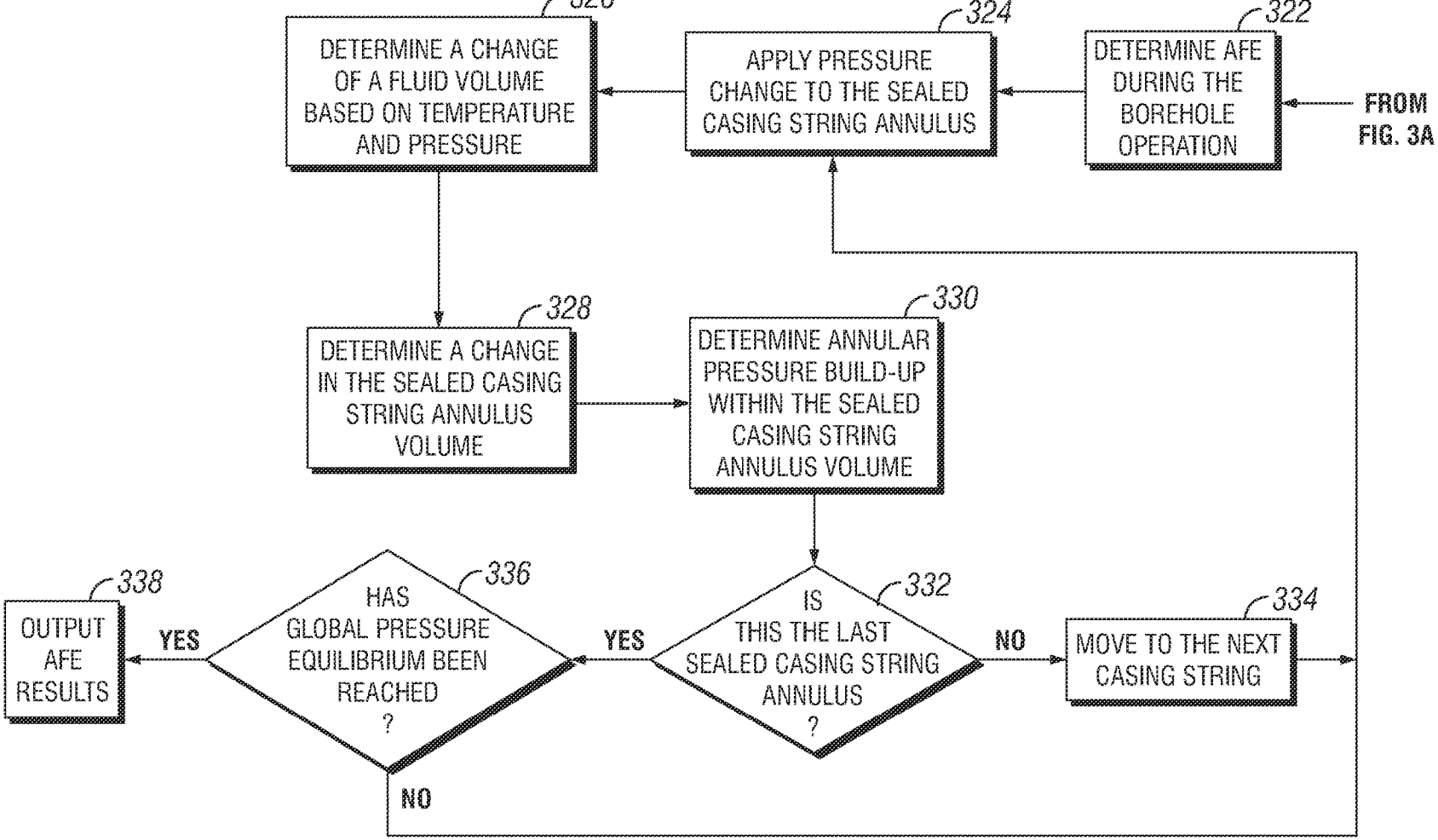
FIG. 3B is a second portion of the flow chart of the method for determining AFE within a borehole.

FIGS. 3A and 3B combined show a flow chart of a method for determining AFE within a borehole, according to one or more embodiments. The method described in reference to FIGS. 3A and 3B is performed by the AFE simulation system 200 described above in reference to FIG. 2. However, the current disclosure is not thereby limited. The method may also be performed by other computer systems that include a processor capable of executing instructions stored on a non-transitory computer-readable medium.

In step 300, a configuration of a borehole is defined by a user. The borehole configuration must include at least one sealed casing string annulus formed between a casing string and the borehole wall. However, the borehole configuration may include multiple sealed casing string annuli between concentric casing strings, such as the sealed casing string annuli 104, 106, 108 formed by the casing strings 112, 114, 116, 118 within the borehole 100 shown in FIG. 1. Additionally, an initial temperature, T1, and an initial pressure, P1, are established for the sealed casing string annuli when the borehole configuration of the borehole is defined.

In step 302, the user defines a production operation and a borehole operation. Exemplary production operations include, but are not limited to, producing hydrocarbons from the formation surrounding the borehole, circulating fluid within the borehole, performing an acid injection into the formation, and shutting in the borehole. Exemplary borehole operations include, but are not limited to, production operations, cementing one or more casing strings within the borehole, drilling the borehole, running liner downhole within the borehole, logging the borehole, producing hydrocarbons from the formation surrounding the borehole, performing an acid injection into the formation, and shutting in the borehole. One skilled in the art will appreciate that many additional operations may be performed within the borehole. The AFE during the production operation is then determined, as shown in step 304.

In step 306, the method applies a pressure change, ΔP, to the sealed casing string annulus. Once the pressure change is applied, the method then determines a change in the fluid volume of fluid within the sealed casing string annulus, ΔVf, based on an initial density, d1, and a final density d2 at the conclusion of the production operation, as shown in step 308. The following equation is used the following equation:

$$\Delta Vf = V1 * \left(\frac{d1}{d2} - 1.0\right)$$

where V1 is the initial fluid volume of the fluid within the sealed casing string annulus. Additionally, as density is a function of pressure and temperature, d1 and d2 can be represented as follows:

$$d1 = f(P1, T1)$$

$$d2 = f(P1 + \Delta P, T2)$$

where P1 is the initial pressure, T1 is the initial temperature, P1+ΔP is the final pressure at the conclusion of the production operation, and T2 is the final temperature at the conclusion of the production operation. The values of T1 and T2 are obtained from the drilling prediction model 212 and/or the production prediction model.

Once the change in fluid volume of the fluid within the sealed casing string annulus is calculated, the change in casing volume is calculated using Lame's equation from conventional elastic theory, as shown in step 310. As the change in casing volume is calculated as a function of initial temperature, initial pressure, final temperature, and final pressure, the change in casing volume, ΔVc, can be represented as follows:

$$\Delta Vc = f(P1, T1, P1 + \Delta P, T2)$$

In step 312, the annular pressure buildup, ΔPa, is calculated such that the following equation is satisfied:

$$\Delta Vf = \Delta Vc$$

Once ΔPa is known for the current sealed casing string annulus, the method then determines if the current sealed casing string annulus is the last sealed casing string annulus in the borehole configuration, as shown at step 314. If there are additional sealed casing string annuli, the method moves to step 316 and steps 306 through 310 for the new sealed casing string annulus.

Once ΔPa is known for all sealed casing string annuli it is then determined if global pressure equilibrium, where ΔP=ΔPa, is reached for all sealed casing string annuli, as shown at step 316. If ΔP≠ΔPa, steps 306 through 316 are repeated and the most recent ΔPa is used in place of ΔP to determine updated values for ΔVf, ΔVc, and ΔPa. This process is continued until global pressure equilibrium is reached as shown by step 318. Once global pressure equilibrium is reached, the data related to the AFE during the production operation, which is the final value of ΔVf and ΔVc, is output to the borehole operation AFE calculation, as shown at step 320. A volume of a vapor cap, Vv, formed during the production operation is also determined as part of the AFE calculation for the production operation and is output as part of the production operation AFE data.

The method then determines the AFE during the borehole operation using the data related to the AFE from the production operation as the initial condition, as shown in step 322. In step 324, a pressure change is applied to a sealed casing string annulus, as described above. ΔVf and ΔVc are then determined for the current sealed casing string annulus, as shown at steps 326 and 328, as described above.

Once ΔVf and ΔVc are determined, the annular pressure buildup within the current sealed casing string annulus, ΔPa, is determined, as shown at step 330. However, the volume of a vapor cap, Vv, formed during the production operation is taken into account when determining ΔPa for the borehole operation. Accordingly, the following equation is used to calculate ΔPa:

$$\Delta Vc = \Delta Vf - Vv$$

Once ΔPa is known for the current sealed casing string annulus, the method then determines if the current sealed casing string annulus is the last sealed casing string annulus in the borehole configuration, as shown at step 332. If there are additional sealed casing string annuli, the method moves to step 334 and steps 306 through 310 for the new sealed casing string annulus.

Once ΔPa is known for all sealed casing string annuli it is then determined if global pressure equilibrium, where ΔP=ΔPa, is reached for all sealed casing string annuli, as shown at step 336. If ΔP≠ΔPa, steps 324 through 336 are repeated and the most recent ΔPa is used in place of ΔP to determine new values for ΔVf, ΔVc, and ΔPa.

Once global pressure equilibrium is reached, the method outputs the total AFE that results from the production operation and the borehole operation, which is the final value of ΔVf for the borehole operation AFE calculation, as shown at step 338. The method may also output the total APB, the final values of ΔPa for the borehole operation AFE calculation, and a stress analysis for the casing strings based on the anticipated stress due to the APB and other load conditions, as described above with reference to FIG. 2. The stress analysis may be used to determine if an existing casing string can maintain structural integrity during potential future borehole operations.

Additionally, the stress analysis may be used to determine what types of piping should be used to form the casing strings of a given well based on expected borehole operations. Once the type of piping has been determined, the piping can be installed within the wellbore as described above with reference to FIG. 1.

Further examples include:

Example 1 is a method for determining annular fluid expansion ("AFE") within a borehole with a sealed casing string annulus. The method includes defining a configuration of the borehole. The method further includes defining a production operation and a borehole operation. The method also includes determining AFE within the borehole when performing the production operation. The method further includes determining AFE within the borehole when performing the borehole operation based on the AFE within the borehole when performing the production operation.

In Example 2, the embodiments of any preceding paragraph or combination thereof further include wherein the borehole configuration comprises multiple sealed casing string annuli.

In Example 3, the embodiments of any preceding paragraph or combination thereof further include wherein determining the AFE within the borehole when performing the production operation comprises determining AFE within each of the multiple sealed casing string annuli and wherein determining AFE within the borehole when performing the borehole operation based on the AFE within the borehole when performing the production operation comprises determining AFE within each of the multiple sealed casing string annuli.

In Example 4, the embodiments of any preceding paragraph or combination thereof further include wherein determining a change in a fluid volume of a fluid within the sealed casing string annulus based on a temperature, a pressure, and an applied pressure change. Determining the AFE within the borehole when performing the production operation also includes determining a change in a casing volume based on the change in the fluid volume. Determining the AFE within the borehole when performing the production operation further includes determining annular pressure build-up within the sealed casing string annulus. Determining the AFE within the borehole when performing the production operation further includes repeating the steps of determining the change in the fluid volume, determining the change in the casing volume, and determining an annular pressure build-up until global pressure equilibrium is reached.

In Example 5, the embodiments of any preceding paragraph or combination thereof further include wherein determining the AFE within the borehole when performing the borehole operation comprises inputting data related to the AFE within the borehole when performing the production operation In Example 6, the embodiments of any preceding paragraph or combination thereof further include wherein determining the AFE within the borehole when performing the borehole operation further includes determining a change in a fluid volume of a fluid within the sealed casing string annulus based on the AFE within the borehole when performing the production operation, a temperature, a pressure, and an applied pressure change. Determining the AFE within the borehole when performing the borehole operation also includes determining a change in a casing volume based on the change in the fluid and a casing deformation when performing the production operation. Determining the AFE within the borehole when performing the borehole operation further includes determining annular pressure build-up within the sealed casing string annulus. Determining the AFE within the borehole when performing the borehole operation also includes repeating the steps of determining the change in the fluid volume, determining the change in the casing volume, and determining the annular pressure build-up until global pressure equilibrium is reached.

In Example 7, the embodiments of any preceding paragraph or combination thereof further include outputting the AFE within the borehole when performing the borehole operation to a display.

Example 8 is a system for determining AFE within a borehole with a sealed casing string annulus. The system includes a processor programmed to implement a user-defined configuration of the borehole. The processor is also programmed to implement a user-defined production operation and implementing a user-defined borehole operation. The processor is further programed to determine AFE within the borehole when performing the production operation. The processor is also programmed to determine AFE within the borehole when performing the borehole operation based on the AFE within the borehole when performing the production operation.

In Example 9, the embodiments of any preceding paragraph or combination thereof further include wherein the borehole configuration comprises multiple sealed casing string annuli.

In Example 10, the embodiments of any preceding paragraph or combination thereof further include wherein the processor is further programmed to determine AFE within each of the multiple sealed casing string annuli when performing the production operation. The processor is also programmed to determine AFE within each of the multiple sealed casing string annuli when performing the borehole operation.

In Example 11, the embodiments of any preceding paragraph or combination thereof further include wherein the processor is further programmed to determine a change in a fluid volume of a fluid within the sealed casing string annulus based on a temperature, a pressure, and an applied pressure change when performing the production operation. The processor is also programmed to determine a change in a casing volume based on the change in the fluid volume. The processor is further programmed to determine annular pressure build-up within the sealed casing string annulus when performing the production operation. The processor is also programmed to repeat the steps of determining the change in the fluid volume, determining the change in the casing volume, and determining the annular pressure build-up until global pressure equilibrium is reached.

In Example 12, the embodiments of any preceding paragraph or combination thereof further include wherein the processor is further programmed to utilize data related to the AFE within the borehole when performing the production operation when determining the AFE within the borehole when performing the borehole operation.

In Example 13, the embodiments of any preceding paragraph or combination thereof further include wherein the processor is further programmed to determine a change in a fluid volume of a fluid within the sealed casing string annulus based on the AFE within the borehole when performing the production operation, a temperature, a pressure, and an applied pressure change when performing the borehole operation. The processor is also programmed to determine a change in a casing volume based on the change in the fluid volume and a casing deformation when performing the production operation. The processor is further programmed to determine annular pressure build-up within the sealed casing string annulus when performing the borehole operation. The processor is also programmed to repeat the steps of determining the change in the fluid volume, determining the change in the casing volume, and the determining annular pressure build-up until global pressure equilibrium is reached.

In Example 14, the embodiments of any preceding paragraph or combination thereof further include a display, wherein the processor is further programmed to output the AFE within the borehole when performing the borehole operation to the display.

Example 15 is a non-transitory computer readable medium comprising instructions which, when executed by a processor, enables the processor to perform a method for determining AFE within a borehole with a sealed casing string annulus. The method includes implementing a user-defined configuration of the borehole. The method also includes implementing a user-defined a production operation and implementing a user-defined a borehole operation. The method further includes determining AFE within the borehole when performing the production operation. The method also includes determining AFE within the borehole when performing the borehole operation based on the AFE within the borehole when performing the production operation.

In Example 16, the embodiments of any preceding paragraph or combination thereof further include wherein the borehole configuration comprises multiple sealed casing string annuli. The method also includes determining the AFE within the borehole when performing the production operation comprises determining AFE within each of the multiple sealed casing string annuli. The method further includes determining AFE within the borehole when performing the borehole operation based on the AFE within the borehole when performing the production operation comprises determining AFE within each of the multiple sealed casing string annuli.

In Example 17, the embodiments of any preceding paragraph or combination thereof further include wherein determining the AFE within the borehole when performing the production operation includes determining a change in a fluid volume of a fluid within the sealed casing string annulus based on a temperature, a pressure, and an applied pressure change. Determining the AFE within the borehole when performing the production operation also includes determining a change in a casing volume based on the change in the fluid volume.

Determining the AFE within the borehole when performing the production operation further includes determining annular pressure build-up within the sealed casing string annulus. Determining the AFE within the borehole when performing the production operation also includes repeating the steps of determining the change in the fluid volume, determining the change in the casing volume, and determining the annular pressure build-up until global pressure equilibrium is reached.

In Example 18, the embodiments of any preceding paragraph or combination thereof further include wherein determining the AFE within the borehole when performing the borehole operation comprises inputting data related to the AFE within the borehole when performing the production operation.

In Example 19, the embodiments of any preceding paragraph or combination thereof further include wherein determining the AFE within the borehole when performing the borehole operation further includes determining a change in a fluid volume of a fluid within the sealed casing string annulus based on the AFE within the borehole when performing the production operation, a temperature, a pressure, and an applied pressure change. Determining the AFE within the borehole when performing the borehole operation also includes determining a change in a casing volume based on the change in the fluid volume and a casing deformation when performing the production operation. Determining the AFE within the borehole when performing the borehole operation further includes determining annular pressure build-up within the sealed casing string annulus. Determining the AFE within the borehole when performing the borehole operation also includes repeating the steps of determining the change in the fluid volume, determining the change in the casing volume, and determining the annular pressure build-up until global pressure equilibrium is reached.

In Example 20, the embodiments of any preceding paragraph or combination thereof further include wherein the method further comprises outputting the AFE within the borehole when performing the borehole operation to a display.

For the embodiments and examples above, a non-transitory machine-readable non-transitory computer readable medium device can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional non-transitory computer readable medium, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method for predicting annular fluid expansion ("AFE") within a borehole using a processor, the method comprising:

defining a configuration of the borehole, wherein the borehole configuration comprises multiple sealed casing string annuli; then defining a simulated production operation and a simulated borehole operation that would be performed before the simulated production operation; then predicting, with the processor a first AFE within each of the multiple sealed casing string annuli associated with the simulated production operation; then predicting, with the processor, a second AFE within each of the multiple sealed casing string annuli associated with the simulated borehole operation based on the predicted first AFE within each of the multiple sealed casing string annuli; and outputting the second AFE within each of the multiple sealed casing string annuli associated with the simulated borehole operation to a display.

2. The method of claim 1, wherein predicting the first AFE within each of the multiple sealed casing string annuli comprises:

determining a change in a fluid volume of a fluid within the sealed casing string annulus based on a temperature, a pressure, and an applied pressure change; then determining a change in a casing volume based on the change in the fluid volume; then determining annular pressure build-up within the sealed casing string annulus; and then repeating the steps of determining the change in the fluid volume, determining the change in the casing volume, and determining the annular pressure build-up until global pressure equilibrium is reached.

3. The method of claim 1, wherein predicting the second AFE within each of the multiple sealed casing string annuli associated with the simulated borehole operation comprises inputting data related to the predicted first AFE within each of the multiple sealed casing string annuli.

4. The method of claim 3, wherein predicting the second AFE within each of the multiple sealed casing string annuli further comprises:

determining a change in a fluid volume of a fluid within the sealed casing string annulus based on the predicted first AFE within each of the multiple sealed casing string annuli, a temperature, a pressure, and an applied pressure change; then, determining a change in a casing volume based on the change in the fluid volume and a casing deformation associated with the simulated production operation; then determining annular pressure build-up within the sealed casing string annulus; and then repeating the steps of determining the change in the fluid volume, determining the change in the casing volume, and determining the annular pressure build-up until global pressure equilibrium is reached.

5. A system for predicting AFE within a borehole, the system comprising a processor programmed to:

implement a user-defined configuration of the borehole comprising multiple sealed casing string annuli; then implement a user-defined simulated production operation and implement a user-defined simulated borehole operation that would be performed before the user-defined simulated production operation; then predict a first AFE, with the processor, within each of the multiple sealed casing string annuli associated with the simulated production operation; and then predict a second AFE, with the processor, within each of the multiple sealed casing string annuli associated with the simulated borehole operation based on the predicted first AFE within each of the multiple sealed casing string annuli; and outputting the second AFE within each of the multiple sealed casing string annuli associated with the simulated borehole operation to a display.

6. The system of claim 5, wherein the processor is further programmed to:

determine a change in a fluid volume of a fluid within the sealed casing string annulus based on a temperature, a pressure, and an applied pressure change associated with the simulated production operation; then determine a change in a casing volume based on the change in the fluid volume; then determine annular pressure build-up within the sealed casing string annulus associated with the simulated production operation; and then repeat the steps of determining the change in the fluid volume, determining the change in the casing volume, and determining the annular pressure build-up until global pressure equilibrium is reached.

7. The system of claim 5, wherein the processor is further programmed to utilize data related to the predicted first AFE within each of the multiple sealed casing string annuli when predicting the second AFE within each of the multiple sealed casing string annuli.

8. The system of claim 7, wherein the processor is further programmed to:

determine a change in a fluid volume of a fluid within the sealed casing string annulus based on the predicted first AFE within each of the multiple sealed casing string annuli, a temperature, a pressure, and an applied pressure change associated with the simulated borehole operation; then determine a change in a casing volume based on the change in the fluid volume and a casing deformation associated with the simulated production operation; then determine annular pressure build-up within the sealed casing string annulus associated with the simulated borehole operation; and then repeat the steps of determining the change in the fluid volume, determining the change in the casing volume, and the determining annular pressure build-up until global pressure equilibrium is reached.

9. A non-transitory computer readable medium comprising instructions which, when executed by a processor, enables the processor to perform a method for determining AFE within a borehole with a sealed casing string annulus, the method comprising:

implementing a user-defined configuration of the borehole, wherein the user-defined configuration comprises multiple sealed casing string annuli; then implementing a user-defined simulated production operation and implementing a user-defined simulated borehole operation that would be performed before the user-defined simulated production operation; then determining a first AFE within each of the multiple sealed casing string annuli associated with the simulated production operation; and then determining a second AFE within each of the multiple sealed casing string annuli associated with the simulated borehole operation based on the determined first AFE within each of the multiple sealed casing string annuli; and outputting the second AFE within each of the multiple sealed casing string annuli to a display.

10. The non-transitory computer readable medium of claim 9, wherein determining the first AFE within each of the multiple sealed casing string annuli comprises:

determining a change in a fluid volume of a fluid within the sealed casing string annulus based on a temperature, a pressure, and an applied pressure change; then determining a change in a casing volume based on the change in the fluid volume; then determining annular pressure build-up within the sealed casing string annulus; and then repeating the steps of determining the change in the fluid volume, determining the change in the casing volume, and determining the annular pressure build-up until global pressure equilibrium is reached.

11. The non-transitory computer readable medium of claim 9, wherein determining the second AFE within each of the multiple sealed casing string annuli comprises inputting data related to the first AFE within each of the multiple sealed casing string annuli.

12. The non-transitory computer readable medium of claim 11, wherein determining the second AFE within each of the multiple sealed casing string annuli associated with the simulated borehole operation further comprises:

determining a change in a fluid volume of a fluid within the sealed casing string annulus based on the first AFE within each of the multiple sealed casing string annuli associated with the simulated production operation, a temperature, a pressure, and an applied pressure change; then determining a change in a casing volume based on the change in the fluid volume and a casing deformation associated with the simulated production operation; then determining annular pressure build-up within the sealed casing string annulus; and then repeating the steps of determining the change in the fluid volume, determining the change in the casing volume, and determining the annular pressure build-up until global pressure equilibrium is reached.

* * * * *